US011129428B2

(12) United States Patent
Marchetto

(10) Patent No.: US 11,129,428 B2
(45) Date of Patent: Sep. 28, 2021

(54) CLOTHING ITEM

(71) Applicant: EQUILINE S.R.L., Trebaseleghe (IT)

(72) Inventor: Paolo Marchetto, Trebaseleghe (IT)

(73) Assignee: EQUILINE S.r.l., Trebaseleghe (IT)

( * ) Notice: Subject to any disclaimer, the term of this patent is extended or adjusted under 35 U.S.C. 154(b) by 282 days.

(21) Appl. No.: 16/028,842

(22) Filed: Jul. 6, 2018

(65) Prior Publication Data

US 2019/0029345 A1 Jan. 31, 2019

(30) Foreign Application Priority Data

Jul. 31, 2017 (IT) ..... 102017000087742

(51) Int. Cl.

| | |
|---|---|
| ***A41B 1/08*** | (2006.01) |
| ***A41D 27/24*** | (2006.01) |
| ***A41D 3/00*** | (2006.01) |
| ***A41D 31/00*** | (2019.01) |
| ***A41D 1/08*** | (2018.01) |
| ***A41D 1/086*** | (2018.01) |
| *A41D 1/04* | (2006.01) |
| *A41D 1/02* | (2006.01) |
| *A41D 31/102* | (2019.01) |

(52) U.S. Cl.

CPC ..... *A41D 27/24* (2013.01); *A41B 1/08* (2013.01); *A41D 1/08* (2013.01); *A41D 1/086* (2013.01); *A41D 3/00* (2013.01); *A41D 31/00* (2013.01); *A41D 1/02* (2013.01); *A41D 1/04* (2013.01); *A41D 31/102* (2019.02); *A41D 2300/22* (2013.01); *A41D 2400/38* (2013.01); *A41D 2500/10* (2013.01); *A41D 2600/10* (2013.01)

(58) Field of Classification Search

CPC ..... A41D 27/24; A41D 1/08; A41D 1/086; A41D 3/00; A41D 31/00; A41B 1/08

See application file for complete search history.

(56) References Cited

U.S. PATENT DOCUMENTS

| | | | | | |
|---|---|---|---|---|---|
| 1,190,504 | A | * | 7/1916 | Bernstein | A41B 1/16 2/127 |
| 2,114,514 | A | * | 4/1938 | York | A41D 27/28 2/93 |
| 2,279,761 | A | * | 4/1942 | Schatten | A41D 27/10 2/93 |
| 2,330,520 | A | * | 9/1943 | Saveth | A41D 27/10 2/93 |

(Continued)

FOREIGN PATENT DOCUMENTS

| | | | |
|---|---|---|---|
| EP | 2 382 882 | A1 | 11/2011 |
| WO | 2009/025526 | A2 | 2/2009 |
| WO | 2017/020004 | A1 | 2/2017 |

*Primary Examiner* — Richale L Quinn

(74) *Attorney, Agent, or Firm* — Oliff PLC

(57) ABSTRACT

The present invention relates to a clothing item made of stretch fabric (6) comprising at least one insert (4) arranged on each side of the clothing item (1; 101; 201). The insert (4) comprises a layer of elastic mesh fabric with a knitted structure (5) internally coupled to a portion of stretch fabric (6) by means of a series of seams (7) passing through the layer of elastic mesh fabric with a knitted structure (5) and the stretch fabric (6). The seams (7) define a plurality of bands (8) formed by the layer of elastic mesh fabric with a knitted structure (5) coupled to the stretch fabric portion (6).

10 Claims, 5 Drawing Sheets

(56) References Cited

U.S. PATENT DOCUMENTS 2,614,258 A * 10/1952 Breier ..... A41D 27/10 2/93
3,231,899 A * 2/1966 Seidel ..... A41D 3/02 2/93
5,704,064 A * 1/1998 van der Sleesen .... A41D 27/28 2/69
6,053,852 A * 4/2000 Wilkinson ..... A41D 13/0015 2/69
6,339,845 B1 * 1/2002 Burns ..... A41D 31/14 2/243.1
6,918,140 B1 * 7/2005 Cooper ..... A41D 1/084 2/228
7,111,328 B2 * 9/2006 Bay ..... A41D 3/00 2/86
7,437,774 B2 * 10/2008 Baron ..... D03D 9/00 2/69
7,540,037 B1 * 6/2009 Bittler ..... A41D 13/0543 2/69
7,950,069 B2 * 5/2011 Lee ..... A41C 1/003 2/227
8,555,414 B2 * 10/2013 Davis ..... A41D 27/28 2/69
8,850,615 B2 * 10/2014 Demarest ..... A41D 27/28 2/69
8,910,319 B2 * 12/2014 Dainese ..... A41D 13/018 2/456
8,984,668 B2 * 3/2015 Tulin ..... A41D 1/06 2/227
9,271,532 B2 * 3/2016 Cole ..... A41D 27/20
9,320,306 B2 * 4/2016 Freddi ..... A41D 1/06
9,603,398 B2 * 3/2017 Hines ..... C08K 5/0091
D793,033 S * 8/2017 Neary ..... D2/742
9,895,569 B2 * 2/2018 Yao ..... A63B 69/0028
10,051,897 B2 * 8/2018 Freddi ..... A41D 13/0017
10,085,492 B2 * 10/2018 Polidan ..... A41B 9/001
10,154,702 B1 * 12/2018 Neary ..... A41D 1/06
10,219,553 B2 * 3/2019 Curran ..... A41D 27/285
10,219,554 B2 * 3/2019 Farron ..... A41D 3/00
10,285,457 B2 * 5/2019 Roup ..... A41D 1/067
10,327,488 B2 * 6/2019 Chumbler ..... A41D 1/089
10,413,005 B2 * 9/2019 Arnold ..... A41D 3/00
2007/0118954 A1 * 5/2007 Lee ..... A41D 27/26 2/69
2008/0060113 A1 * 3/2008 Walsh ..... A41D 27/10 2/116
2009/0181599 A1 * 7/2009 Farmer ..... A42B 1/00 450/39
2011/0214216 A1 * 9/2011 Zarabi ..... A41D 1/00 2/69
2014/0020149 A1 1/2014 Yamada et al.
2015/0374050 A1 * 12/2015 Farron ..... A41D 3/00 2/95
2016/0219947 A1 * 8/2016 Nhim ..... A41D 27/20
2016/0295933 A1 * 10/2016 Herbener ..... A41D 27/20
2018/0098588 A1 * 4/2018 Pezzimenti ..... A41D 27/24
2018/0271193 A1 * 9/2018 Aitch ..... A41D 1/04

* cited by examiner

CLOTHING ITEM

TECHNICAL FIELD OF THE INVENTION

The present invention relates to a clothing item, in particular to a piece of sportswear or leisure wear.

PRIOR ART

Currently clothing items are known, in particular for the sports or leisure sector, which allow the user maximum freedom of movement and, generally, provide breathability to make them more comfortable in use, a particularly important aspect during the performance of a sports activity.

For this purpose, stretch and/or breathable fabrics, commonly referred to as "technical fabrics", have been made which use particularly advanced technologies and materials in their manufacture.

The clothing items that are used in particular in the sports sector must satisfy multiple technical requirements, among which the main ones are essentially:

- elasticity, to allow the garment to adhere perfectly to the user's body while allowing maximum freedom of movement,
- breathability for the comfort of the user,
- resistance to wear to resist the continuous rubbing of the fabric during the sports activity.

In addition to the above technical requirements, sometimes an item of sportswear also requires a certain formal elegance depending on the context in which the sport is carried out, such as, for example, equitation, fencing, artistic skating, dance, golf, polo, etc.

Technical Problem

It would therefore be desirable to have a clothing item, particularly for the sports or leisure sector, which combines the above-listed technical requisites with the aesthetic prerequisite of giving the user a certain degree of formal elegance when worn or improving the appearance of the user.

SUMMARY OF THE INVENTION

The main task of the present invention is to overcome the drawbacks of the prior art by making a clothing item able to combine the technical requirements of elasticity, breathability and durability with a high aesthetic quality to give the user a certain degree of formal elegance or to improve the appearance of the user.

Within the scope of the aforementioned task, an object of the present invention is to provide a clothing item, in particular an item of sportswear, capable of improving both the comfort and the appearance of the user and the performance thereof during the sports activity.

Last by not least, the object is to provide a piece of clothing that achieves the aforementioned task and objectives at a competitive cost and which is achievable with the usual and known systems, machinery and equipment.

The task and the objectives indicated above, and others which will be better explained in the following description, are achieved by a clothing item as defined in claim 1.

BRIEF DESCRIPTION OF THE FIGURES

Further features and advantages of the present invention will become more apparent from the following description of some specific, but not exclusive, embodiments illustrated purely by way of an indicative and non-limiting example with reference to the attached figures, wherein.

DETAILED DESCRIPTION OF THE INVENTION

Figures 1, 2, 3:
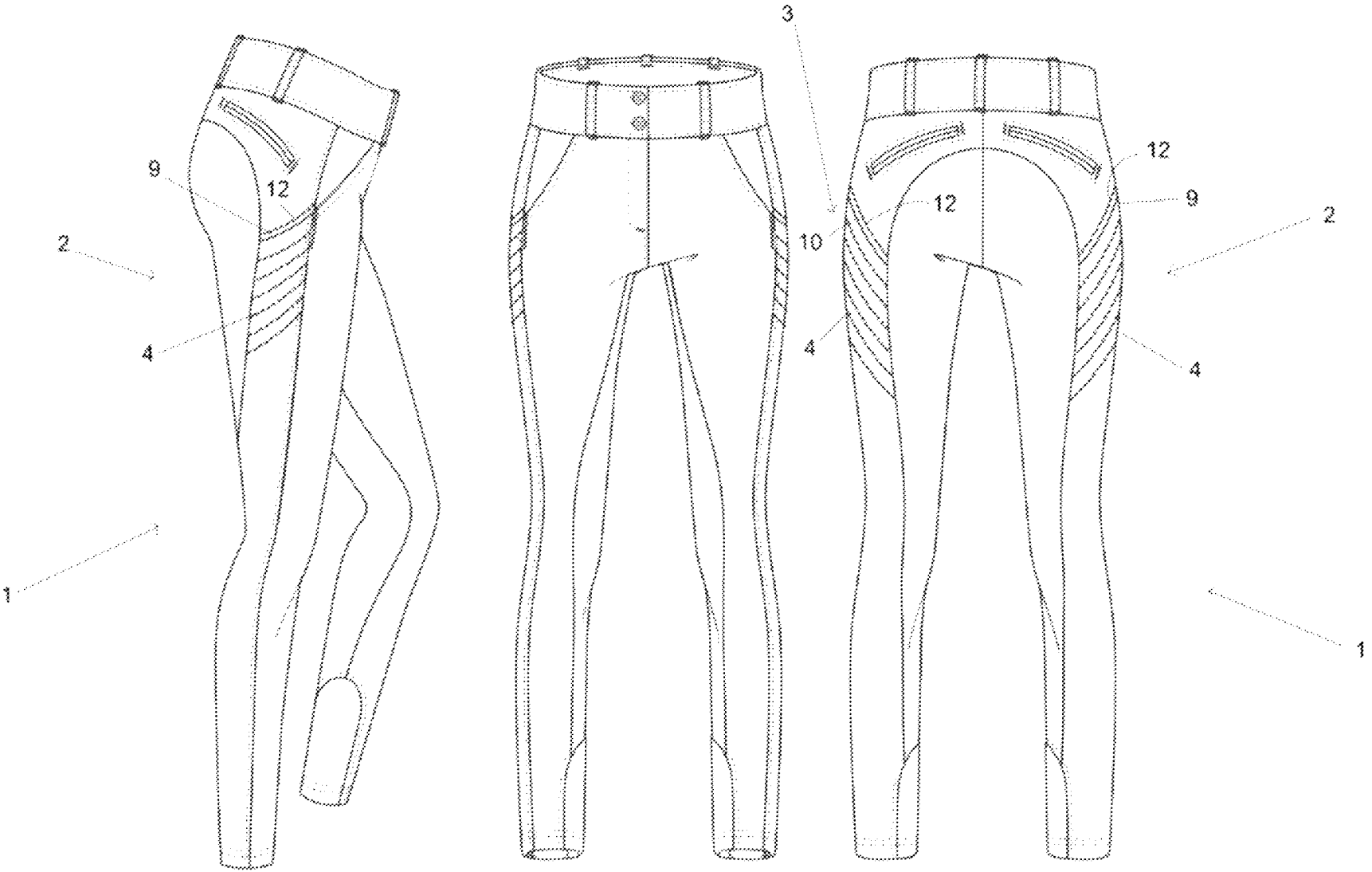
FIGS. 1, 2 and 3 show, respectively, a side, front and rear view of a clothing item, consisting of trousers, according to the present invention.
Figure 5:
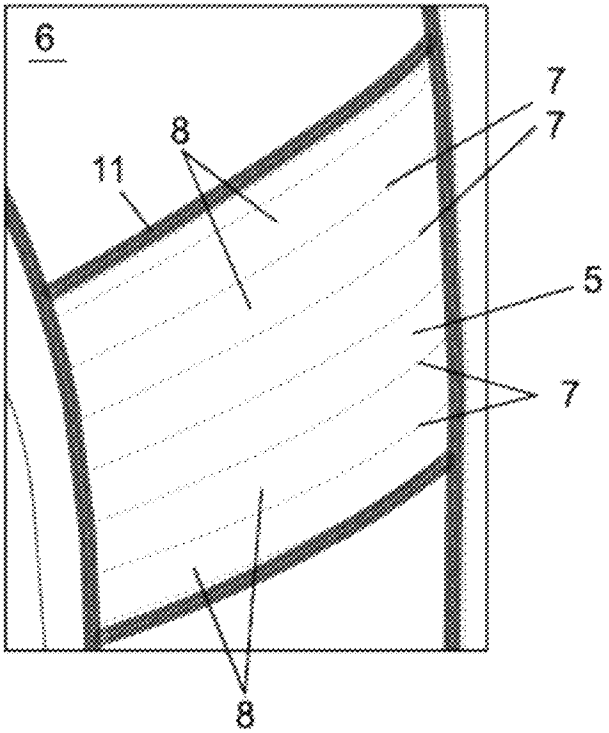
FIG. 5 shows a detail of the inner part of the clothing item according to the preceding figures.

With reference to the aforementioned figures, a clothing item, in the embodiment illustrated in FIGS. 1 to 4, consisting of a pair of trousers, for example for equitation, made of an elasticized and breathable fabric 6, is indicated at the reference number 1. Advantageously, the fabric is of the 4-way stretch type, that is, elasticized with a stretching capacity in four directions so as to allow ample freedom of movement and adaptation to the user's anatomy.

At each side of the trousers, at least on the portions corresponding to the hip/outside thigh regions 2, 3, an insert 4 is coupled to the inside of the stretch fabric 6. The insert 4 comprises a layer 5 of technical elastic mesh fabric with a knitted structure, technically known as "mesh", a term which will be used in the following for the sake of brevity. Preferably said fabric is of the 2-way stretch mesh type, with an elongation capacity along two directions.

Figure 7:
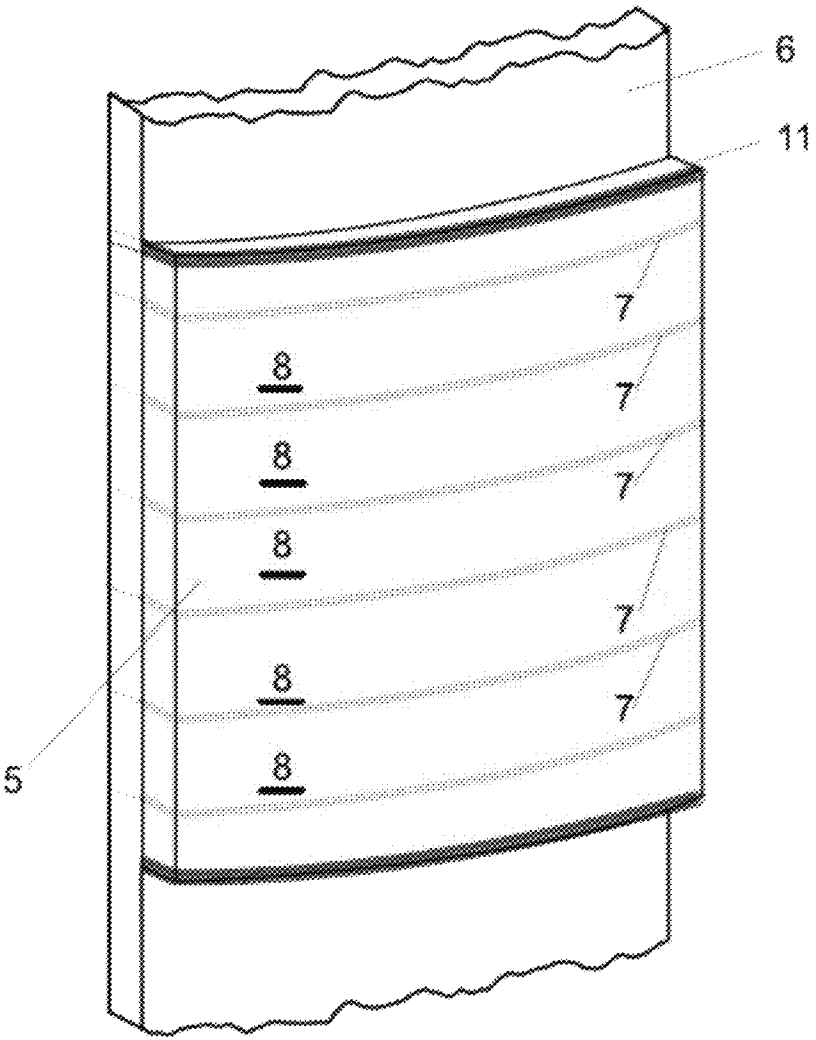
FIGS. 6 and 7 show, according to a perspective view of the outer part and of the inner part respectively, a detail of the clothing item according to the present invention.
Figure 6:
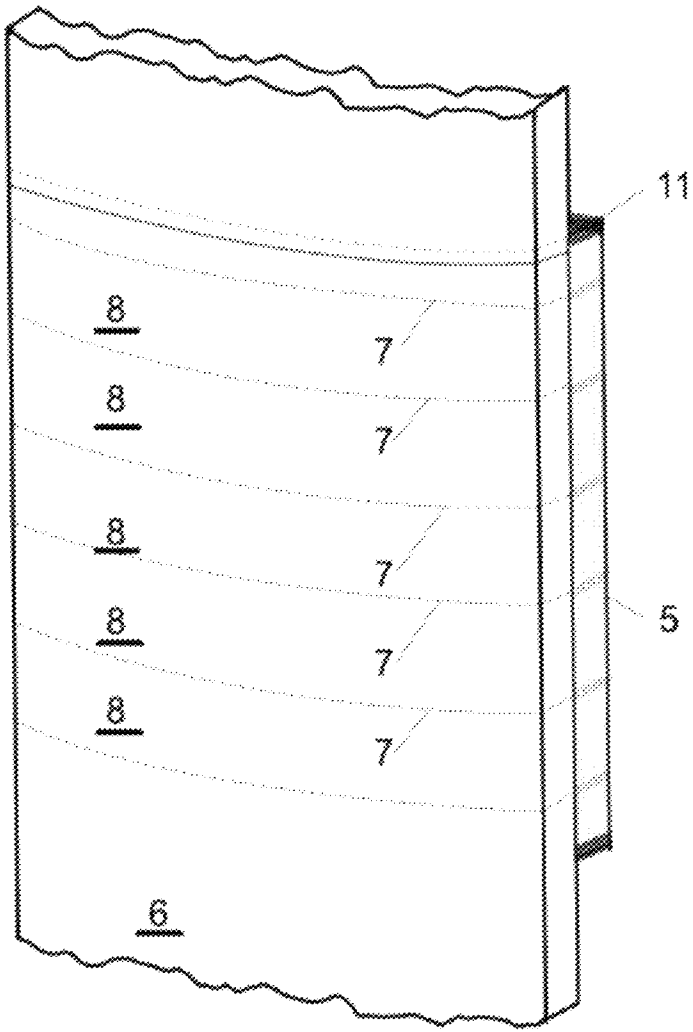

As shown in FIGS. 6 and 7, the mesh fabric layer 5 is coupled to a portion of stretch fabric 6 of the trousers 1 by means of a series of seams 7 passing between the two fabrics 5, 6 and arranged substantially parallel to each other and spaced apart, the purpose of which will be better explained hereinafter; as shown in FIGS. 1 to 4, the seams 7 are slanted with respect to the longitudinal extension of the trousers 1 and oriented towards the front upper part of the same trousers 1. Advantageously, the seams 7 have a slightly arched shape to follow the anatomical shape of the area concerned.

The seams 7 join therefore in a pass-through way the layer of mesh fabric 5 and stretch fabric 6 of the trousers so as to substantially form bands 8, the configuration of which is defined by the seams 7. According to a preferred embodiment, the bands 8 will then be formed by the combined coupling of a portion of 4-way stretch fabric 6, on the outside, and by the layer of 2-way elastic mesh fabric 5.

Figure 4:
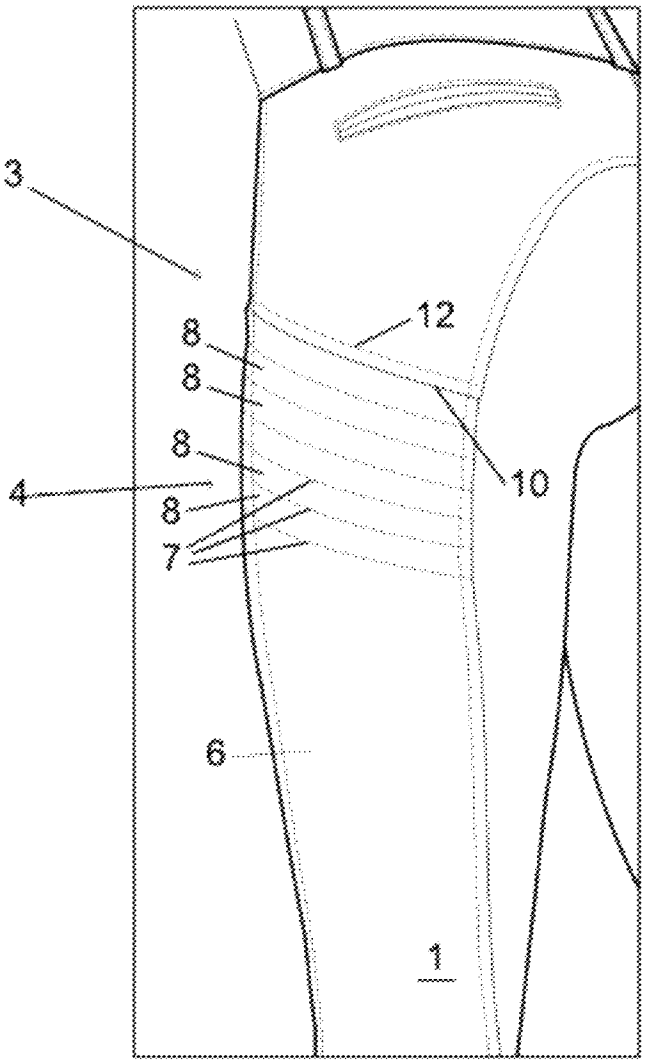
FIG. 4 shows a detail of the clothing item according to the preceding figures.

Advantageously, on the stretch fabric 6 of the trousers 1 ergonomic cuts 9, 10 may be made, at least one on each side, concerning the areas of the gluteus maximus and the biceps femoris and arranged at the upper edge 11 of the mesh fabric layer 5. The configuration of the ergonomic cuts 9, 10, both in orientation and shape, will be essentially the same as the configuration of the seams 7. The cuts 9, 10 on the stretch fabric 6 will be closed by a further seam 12 of a retracted type, i.e., the edge of the cut 9, respectively 10, is folded inside and joined with the retracted seam 12 to the upper edge 11 of the fabric mesh layer 5, as shown in FIG. 4.

The combined technical effect resulting from the coupling of the mesh fabric layer 5 to the stretch fabric 6 by the series of seams 7 allows the trousers 1 to adhere perfectly to the anatomy of the leg in the area concerned, due to the compression exerted on the same leg by the combination of the two fabrics having different elastic features—4-way stretch on the outside and 2-way stretch on the inside—allowing at the same time a wide freedom of movement. The seams 7, configured in such a way as to follow the shape and the musculature of the anatomical area concerned, provide the resulting structural combination with a containment effect to control the elastic extension of the two fabrics joined together in a preferential direction corresponding to the longitudinal extension of the seams 7.

The adherence and the compression on the leg exerted by the coupling of the mesh fabric layer 5 to the stretch fabric 6 also encourages the microcirculation of the blood, allowing a rapid recovery from muscular stress during sports activity.

The support provided by the coupled structure of the two fabrics 5, 6 also gives the user an improved silhouette due to a "push-up" effect particularly appreciated by female users, while at the same time allowing maximum freedom in movement.

A further technical effect deriving from the compression and support of the leg consists in the reduction of lactic acid formation and therefore less discomfort for the user at the end of the sports activity.

The possible presence of ergonomic cuts 9, 10 near the muscular areas of the gluteus maximus and the biceps femoris, closed and joined to the mesh fabric layer 5 by the retracted seam 12, allows the anatomy of the leg to be followed and shaped in these zones, thus increasing the supporting effect on these muscles, and thus further improving the "push-up" effect.

Overall, the aforementioned technical effects lead to a significant improvement in the athlete's performance during sports competitions and in his/her aesthetic appearance.

From the foregoing it is therefore evident that the present invention achieves the objectives and advantages initially envisaged: in effect, a clothing item has been produced capable of combining the technical requirements of elasticity, breathability and durability with an aesthetic quality to improve the aesthetic appearance of the user of the product.

The combined effect of the inserts 4, comprising the mesh fabric layer 5 joined to a corresponding portion of stretch fabric 6 by means of the seams 7, applied to the sides of the clothing item at least near the gluteal areas, makes it possible to improve both the comfort and the aesthetic appearance of the user, as well as his/her performance during sports activity through the adherence and compression of the trousers on the leg provided by the same inserts.

Naturally, the present invention is adaptable to numerous applications, modifications or variations without thereby leaving the scope of protection as defined by the independent claim 1.

Figure 10:
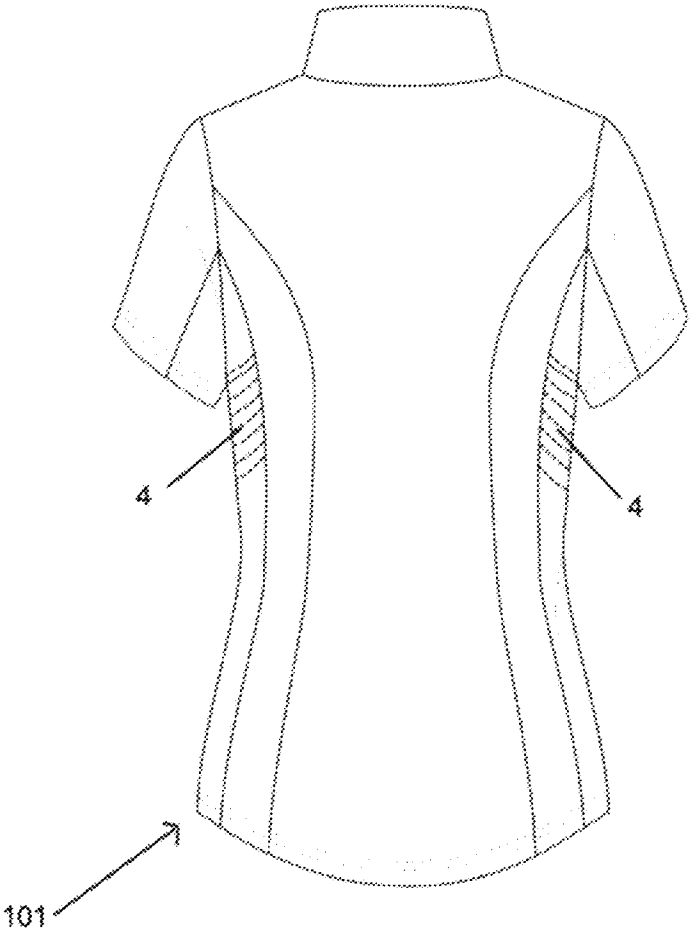
FIGS. 8, 9 and 10 show, respectively, a side, front and rear view of a different embodiment of a clothing item, consisting of a polo shirt, according to the present invention.
Figure 9:
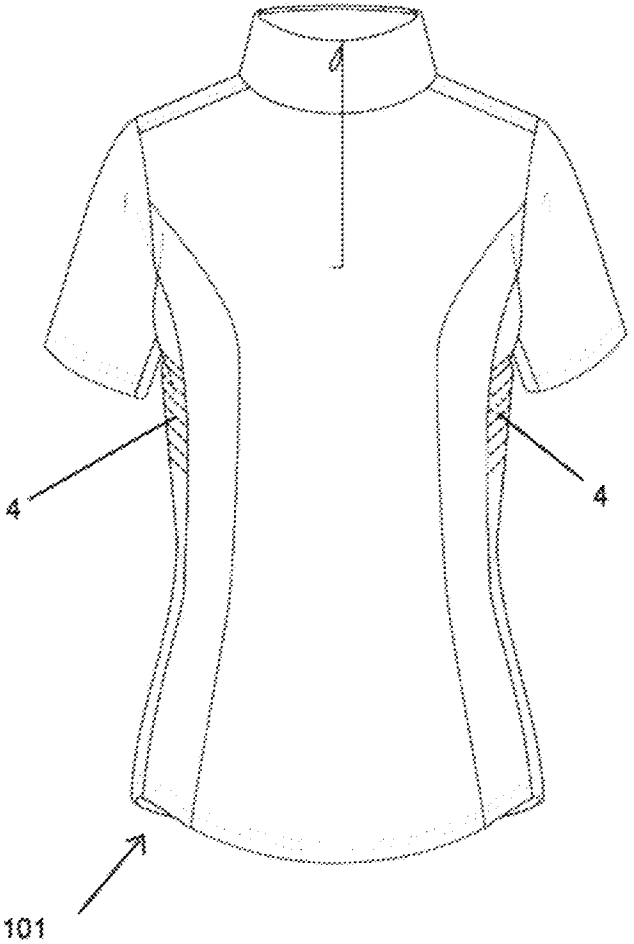
Figure 8:
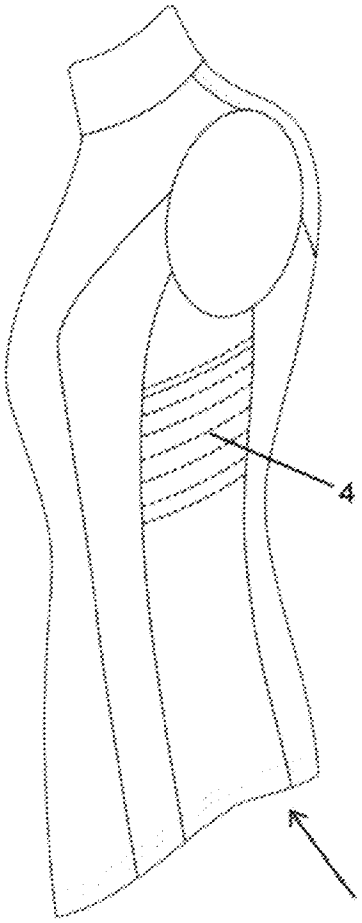

For example, FIGS. 8 to 10 show the application of a pair of inserts 4, one on each side, to a clothing item 101, consisting of a polo shirt or shirt, as described above. A mesh fabric layer 5, similarly to that which is shown in FIGS. 6 and 7, is then coupled internally to a portion of stretch fabric 6 comprising the polo shirt 101, at least on the sides at the height of the ribs, by means of a series of seams 7, slanted and configured to follow and shape the anatomy of the areas concerned. The seams 7 give rise to a series of bands 8, formed by the coupling of the portion of stretch fabric 6 with the mesh fabric layer 5.

Advantageously, ergonomic cuts 9, 10 may be provided on the fabric 6, one on each side, similarly to that described in the foregoing.

The improved adhesion and the support conferred by the inserts 4 in the rib zones have the task of providing a "push-up" effect to the breast, an effect particularly appreciated by female users to improve their aesthetic appearance.

Figure 13:
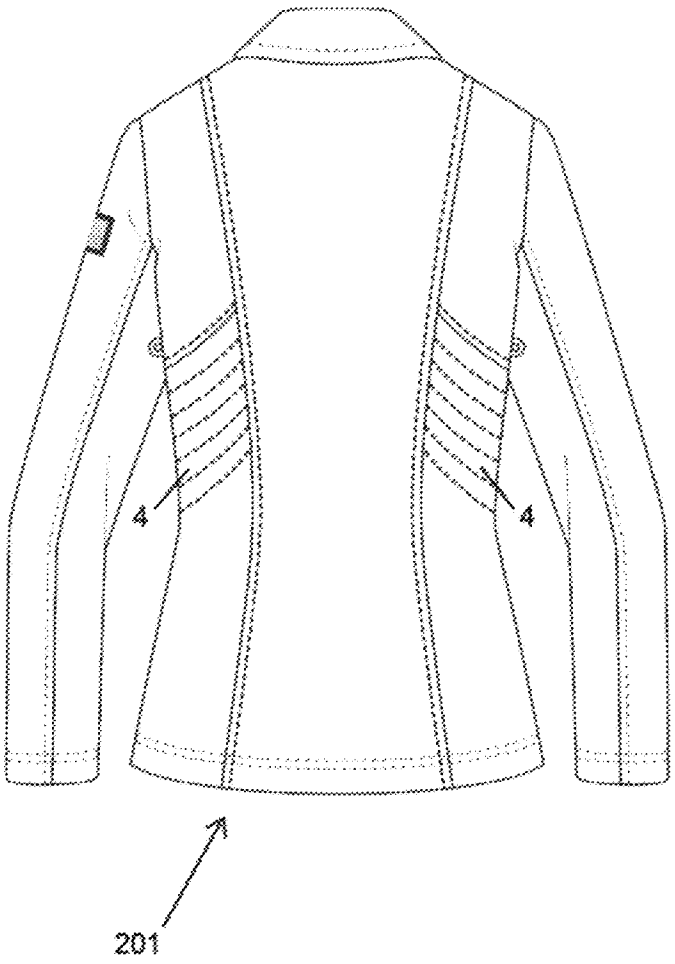
FIGS. 11, 12 and 13 show, respectively, a side, front and rear view of a further embodiment of a clothing item, consisting of a jacket, according to the present invention.
Figure 12:
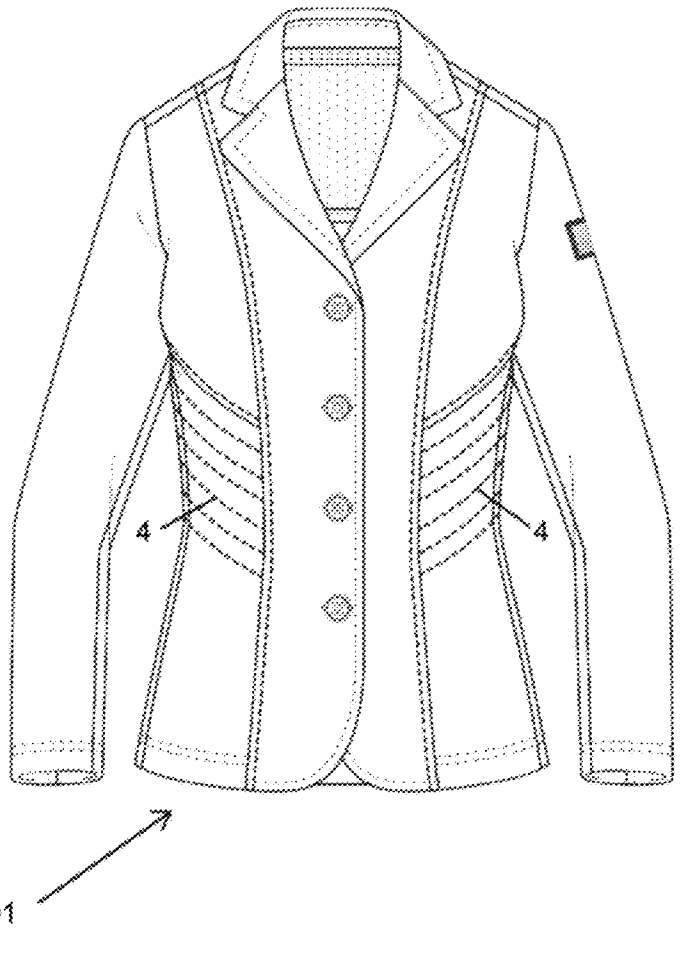
Figure 11:
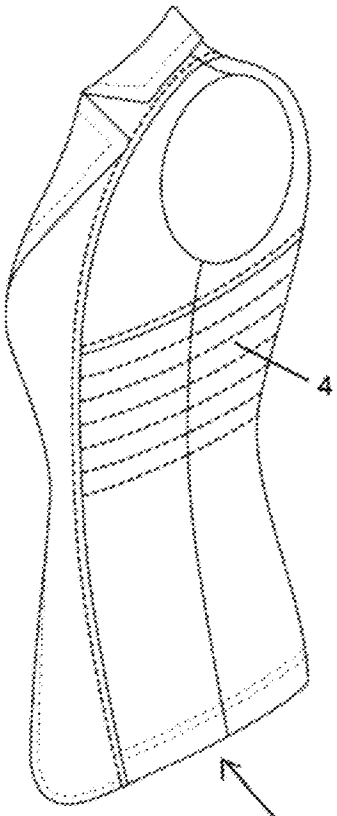

Similarly, the pair of inserts 4 may be applied to the sides of a jacket 201, as illustrated in FIGS. 11 to 13, with the same technical methods and effects described above.

Naturally, the materials and equipment used for the production of the present invention, as well as the shapes and sizes of the individual components, may be those most suitable according to the specific requirements.

The invention claimed is:

1. A clothing item that is a pair of trousers, the clothing item being made of a stretch fabric comprising an insert arranged on each of left and right sides of said clothing item, wherein each insert comprises a layer of elastic mesh fabric coupled at an inner portion of said stretch fabric by a plurality of seams passing through said layer of elastic mesh fabric and said stretch fabric, said plurality of seams defining a plurality of bands formed by said layer of elastic mesh fabric coupled to said inner portion of stretch fabric, said plurality of bands being disposed in a row so as to be adjoining each other, wherein said plurality of seams:

are arranged mutually spaced and substantially parallel to each other, extend between a front side of the clothing item and a back side of the clothing item, and are inclined with respect to a front-back direction of the clothing item, the front-back direction being defined by the front side and the back side, and said insert, said elastic mesh fabric, said plurality of seams, and said plurality of bands are arranged on each left and right side of said pair of trousers and are configured to cover at least regions of hips and outer thighs of a wearer of the pair of trousers.

2. The clothing item as in claim 1, wherein said stretch fabric is a 4-way stretch fabric having an elongation capacity along four directions.

3. The clothing item as in claim 1, wherein said layer of elastic mesh fabric is a 2-way elastic mesh fabric having an elongation capacity along two directions.

4. The clothing item as in claim 1, wherein said plurality of seams control an elastic elongation of said coupled layer of elastic mesh fabric and stretch fabric along a preferential direction corresponding to a longitudinal extension of said plurality of said seams.

5. The clothing item as in claim 1, wherein at least an ergonomic cut is provided on said stretch fabric, and a retracted seam is adapted to seal said at least an ergonomic cut and to join an upper edge of said layer of elastic mesh fabric at said at least an ergonomic cut.

6. A clothing item that is a shirt, a polo shirt, or a jacket, the clothing item being made of a stretch fabric comprising an insert arranged on each of left and right sides of said clothing item, wherein each insert comprises a layer of elastic mesh fabric coupled at an inner portion of said stretch fabric by a plurality of seams passing through said layer of elastic mesh fabric and said stretch fabric, said plurality of seams defining a plurality of bands formed by said layer of elastic mesh fabric coupled to said inner portion of stretch fabric, said plurality of bands being disposed in a row so as to be adjoining each other, wherein said plurality of seams:

are arranged mutually spaced and substantially parallel to each other, extend between a front side of the clothing item and a back side of the clothing item, and are inclined with respect to a front-back direction of the clothing item, the front-back direction being defined by the front side and the back side, and said insert, said elastic mesh fabric, said plurality of seams, and said plurality of band are arranged on each left and right side of said shirt of polo shirt or jacket and are configured to cover at least regions of ribs of a wearer of the clothing item.

7. The clothing item as in claim 6, wherein said stretch fabric is a 4-way stretch fabric having an elongation capacity along four directions.

8. The clothing item as in claim 6, wherein said layer of elastic mesh fabric is a 2-way elastic mesh fabric having an elongation capacity along two directions.

9. The clothing item as in claim 6, wherein said plurality of seams control an elastic elongation of said coupled layer of elastic mesh fabric and stretch fabric along a preferential direction corresponding to a longitudinal extension of said plurality of said seams.

10. The clothing item as in claim 6, wherein at least an ergonomic cut is provided on said stretch fabric, and a retracted seam is adapted to seal said at least an ergonomic cut and to join an upper edge of said layer of elastic mesh fabric at said at least an ergonomic cut.

* * * * *